US006041298A

United States Patent [19]

Gortz

[11] Patent Number: 6,041,298

[45] Date of Patent: Mar. 21, 2000

[54] METHOD FOR SYNTHESIZING A FRAME OF A SPEECH SIGNAL WITH A COMPUTED STOCHASTIC EXCITATION PART

[75] Inventor: Udo Gortz, Bochum, Germany

[73] Assignee: Nokia Mobile Phones, Ltd., Espoo, Finland

[21] Appl. No.: 08/947,419

[22] Filed: Oct. 8, 1997

[30] Foreign Application Priority Data

Oct. 9, 1996 [DE] Germany ..... 196 41 619

[51] Int. Cl.[7] ..... G10L 9/04

[52] U.S. Cl. ..... 704/223; 704/264

[58] Field of Search ..... 704/213, 219, 704/221, 222, 223, 264, 200, 266, 224, 225

[56] References Cited

U.S. PATENT DOCUMENTS

| | | | |
|---|---|---|---|
| 5,091,945 | 2/1992 | Kleijn | 704/219 |
| 5,265,167 | 11/1993 | Akamine et al. | 704/219 |
| 5,327,519 | 7/1994 | Haggvist et al. | 395/2.28 |
| 5,432,884 | 7/1995 | Kapanen et al. | 395/2.37 |
| 5,444,816 | 8/1995 | Adoul et al. | 395/2.28 |
| 5,526,366 | 6/1996 | Jarvinen et al. | 371/31 |
| 5,579,433 | 11/1996 | Jarvinen | 395/228 |
| 5,602,961 | 2/1997 | Kolesnik et al. | 704/223 |
| 5,701,392 | 12/1997 | Adoul et al. | 704/219 |
| 5,717,825 | 2/1998 | Lamblin | 704/223 |
| 5,742,733 | 4/1998 | Jarvinen | 704/220 |
| 5,893,061 | 4/1999 | Gortz | 704/262 |

FOREIGN PATENT DOCUMENTS

| | | | |
|---|---|---|---|
| 90 06 717 | 11/1991 | Germany | G01L 9/04 |

OTHER PUBLICATIONS

Time–domain coding of (near) toll quality speech at rates below 16 KB/S, Peter Kroon, Delft University of Technology, Mar. 1995, pp. ii–iv, contents pp. ix–xviii.

*Primary Examiner*—Richemond Dorvil
*Attorney, Agent, or Firm*—Perman & Green, LLP

[57] ABSTRACT

The invention describes one way of coding a speech signal without the elaborate searhing of a stochastic codebook. An "ideal" Regular Pulse Excitation (RPE) is used as the starting point for the method. The five strongest RPE pulses are quantized with equal amplitude and differ by their sign. The other RPE pulses are set to zero. This method, which is simple and can be carried out quickly, provides the same speech quality as with considerably more elaborate closed-loop methods.

4 Claims, 5 Drawing Sheets

IDEAL RPE-SEQUENCE

STOCHASTIC EXCITATION
(TRANSMITTED TO THE DECODER)

| FIG.3A | FIG.3B |
|---|---|

METHOD FOR SYNTHESIZING A FRAME OF A SPEECH SIGNAL WITH A COMPUTED STOCHASTIC EXCITATION PART

Essentially all time-domain speech coders to which this document relates, work on the same principle: a linear synthesis filter has an excitation signal applied to it in such a way that its output signal gives the best possible approximation of the speech signal to be transmitted, on the basis of an error measure which is to be established. The excitation signal often consists of two parts. The first is intended to help rebuild the harmonic, usually voiced speech components, and the second is intended to help rebuild the noisy speech components. The actual sound formation, which in the real vocal tract takes place through the oronasopharyngeal space, is performed by the synthesis filter. This being the case, the speech quality which can be achieved depends essentially on the excitation of the synthesis filter.

Having comparatively low complexity, so-called residual signal coders, for example the RPE-LTP speech coder currently used in digital mobile radiocommunications, do not achieve the currently required speech quality with bit rates significantly above 10 kb/s. Conversely, analysis-by-synthesis speech coders working with the CELP principle (CELP=Code Excited Linear Prediction), which do not transmit the speech signal itself, but instead parameters which describe it, do actually achieve a significantly better speech quality in the same bit rate range than residual signal coders, but this is at the cost of considerably greater complexity, this outlay being substantially entailed by searching codebooks for determining the stochastic excitation.

It would therefore be desirable to simplify the determination of the excitation without reducing the speech quality. Considerable simplifications are to be expected if the searching of codebooks can be restricted by means of a good, simple to determine preselection criterion to a small number of code vectors, or even if the stochastic codebook search can be fully omitted, should it be possible to derive the stochastic excitation directly from the speech signal, without thereby increasing the transmission rate. This method has so far not been successful, for example at bit rates of about 13 kb/s, on account of failure to quantize the residual signal sufficiently well with the available data rate, and for this reason the stochastic excitation is determined using the CELP principle even with time-domain approaches in a bit rate range of about 13 kb/s.

DE 90 067 17 U1 has already disclosed speech synthesis using an RPE codeword.

The starting point of the invention is an "ideal" RPE sequence. This is determined as earlier specified by P. Kroon in his dissertation "Time-domain coding of (near) toll quality speech at rates below 16 kb/s", Delft University of Technology, March 1985. The determination of the RPE and the variant of this excitation type which is used in the RPE-LTP coder, will therefore be dealt with first.

Calculation of the "Ideal RPE"

The excitation vector to be determined will be assumed to be N samples long. In general, each of these samples has its own amplitude and its own sign. In practice, however, for reasons of outlay it is necessary to restrict the number of non-zero pulses. One possible way of achieving this outlay reduction is so-called regular pulse excitation (RPE). If, for example, every second pulse is non-zero, there are two possible ways of placing N/2 pulses in a vector of length N in such a way that there is always a zero between two non-zero pulses. The first, third, . . . pulse is non-zero, or the second, fourth, . . . pulse is non-zero. If there are L non-zero pulses, with L<=N, then every (N/L)-th pulse is non-zero and there are (N−(N/L)*(L−1)) possible ways of producing an RPE sequence (both division operations are integer divisions). The first non-zero pulse can be located at (N−(N/L)*(L−1)) different positions. The best set of amplitudes for a target vector to be approximated is calculated as follows. The following variables will first be defined:

p target vector, (1*N) matrix h impulse response of the synthesis filter, (1*N) matrix H impulse response matrix, (N*N) matrix M distribution of non-zero pulses in the excitation vector, (N*L) matrix b non-zero phase amplitudes, (1*L) matrix c excitation vector, (1*N) matrix c' filtered excitation, (1*N) matrix e difference between filtered excitation and target signal (error vector), (1*N) matrix E error measure, scalar The excitation vector is given by $$c=b\cdot M,$$

the filtered excitation vector is $$c'=b\cdot M\cdot H.$$

The error to be minimized is $$E=p-c'.$$

The distance measure used is the sum of the squares of the errors.

$$E=e\cdot e^T.$$

Substituting for e in the equation by the above-mentioned relationships gives $$E=p\cdot p^T-2\cdot H^T\cdot M^T\cdot b^T+b\cdot M\cdot H\cdot H^T\cdot M^T\cdot b^T.$$

Partial differentiation with respect to the components of the pulse amplitude vector b $$\frac{\partial E}{\partial b^T}=0$$

leads to the set of best amplitudes for the respective distribution of the non-zero pulses (matrix M).

$$b^T=p\cdot H^T\cdot M^T\cdot(M\cdot H\cdot H^T\cdot M^T)^{-1}.$$

The impulse response matrix has the following form $$H=\begin{matrix} h(0) & h(1) & h(2) & h(3) & \dots & h(N-1) \\ 0 & h(0) & h(1) & h(2) & \dots & h(N-2) \\ 0 & 0 & h(0) & h(1) & \dots & h(N-3) \\ 0 & 0 & 0 & h(0) & \dots & h(n-4) \\ \dots & \dots & \dots & \dots & \dots & \dots \\ 0 & 0 & 0 & 0 & 0 & h(0) \end{matrix}.$$

For the case when L=N/2, M is given by the following two matrices $$M^{(1)} = \begin{matrix} 1 & 0 & 0 & 0 & 0 & 0 & 0 & \dots & \dots & 0 \\ 0 & 0 & 1 & 0 & 0 & 0 & 0 & \dots & \dots & 0 \\ 0 & 0 & 0 & 0 & 1 & 0 & 0 & \dots & \dots & 0 \\ \dots & \dots & \dots & \dots & \dots & \dots & \dots & \dots & \dots & \dots \\ 0 & 0 & 0 & 0 & 0 & 0 & 0 & \dots & 1 & 0 \end{matrix}$$

$$M^{(2)} = \begin{matrix} 0 & 1 & 0 & 0 & 0 & 0 & 0 & \dots & 0 \\ 0 & 0 & 0 & 1 & 0 & 0 & 0 & \dots & 0 \\ 0 & 0 & 0 & 0 & 0 & 1 & 0 & \dots & 0 \\ \dots & \dots & \dots & \dots & \dots & \dots & \dots & \dots & \dots \\ 0 & 0 & 0 & 0 & 0 & 0 & 0 & \dots & 1 \end{matrix}$$

Generally, for an RPE, there is only one non-zero element in each row of M, the n-th row specifying the position of the n-th pulse of the RPE. If there are m possible ways of using L non-zero pulses to form an RPE, the matrix M also assumes m different forms. The "ideal RPE sequence" is the one which, according to the above calculation, minimizes the error measure E.

RPE Determination for an RPE-LTP Coder

The above-described determination of the RPE requires the solution of a system of coupled linear equations. When the RPE-LTP coder was defined, there was not enough computing power to implement the algorithm in a mobile telephone intended for mass production. For this reason, a simplified RPE variant is employed. After decorrelation filtering of the speech signal to be transmitted, a residual signal remains which has a theoretically white spectrum in the frequency range of interest. If all the spectral components have equal intensity, transmission of the entire band is not necessary, and it is sufficient to transmit the baseband, which is obtained by subsampling the residual signal after prior low-pass filtering. This reduces the number of pulses to be transmitted and therefore the transmission rate. At the decoder, the untransmitted high band can be recovered by interpolation filtering.

In the calculation of the "ideal RPE" in the previous section, the residual signal was not explicitly necessary, and so the two methods may at first seem very different. In fact, however, the method used in the RPE-LTP coder can be interpreted as an approximation of the method previously described. The above-described RPE calculation can be carried out equivalently if the residual signal, when including it, is subdivided into 5 the following steps:

filtering the residual signal r(n) using an FIR filter F(z) of length N→y(n), sampling (decimating) the filtered residual signal→z(n), increasing the sampling rate from z(n) to the original→c (n), synthesis filtering of this signal→/v(n), calculation of the synthesis error→E, minimizing the synthesis error by suitable choice of the coefficients of F(z)→$\{f_0, f_1, \dots, f_{N-1}\}$.

Those N filter coefficients which, on filtering and sampling of the residual signal which is provided, give rise to the minimum error, are therefore looked for. In matrix notation, this gives:

$$y = f \cdot R$$

$$z = y \cdot M'$$

-continued $$c = z \cdot M$$

$$v = c \cdot H = f \cdot R \cdot M' \cdot M \cdot H$$

$$E = p \cdot p' - 2p \cdot v' + v \cdot v'$$

$$= p \cdot p' - 2p \cdot H' \cdot M' \cdot M \cdot R' \cdot f' + f \cdot R \cdot M' \cdot M \cdot H \cdot H' \cdot M' \cdot M \cdot R' \cdot f'$$

$$\frac{\partial E}{\partial f'} = 0 \Rightarrow f \cdot R \cdot M' \cdot M \cdot H \cdot H' \cdot M' \cdot M \cdot R'$$

$$= p \cdot H' \cdot M' \cdot M \cdot R' \text{ setting } A = R \cdot M' \cdot M \cdot H$$

$$f \cdot A \cdot A' = p \cdot A'$$

with f (1×N) matrix,

R (N×N) matrix,

M (Np×N) matrix, p (1×N) matrix and $$R = \begin{pmatrix} r(0) & r(1) & \dots & r(N-1) \\ r(-1) & r(0) & \dots & r(N-2) \\ \dots & \dots & \dots & \dots \\ r(-(N-1)) & r(-(N-2)) & \dots & r(0) \end{pmatrix}.$$

The values r(0), r(1), . . . , r(N−1) represent the current residual signal, r(−(N−1)), r(−(N−2)), . . . , r(−1) are previous signal values.

By way of example, M is specified for the case when the first non-zero pulse is at the first position in the RPE vector and every second pulse is non-zero: $\{a_0, 0, a_1, 0, a_3, 0, \dots, a_{N-2}, 0\}$. In general, M is constructed as specified above.

$$M = \begin{pmatrix} 1 & 0 & 0 & 0 & 0 & \dots & 0 & 0 \\ 0 & 0 & 1 & 0 & 0 & \dots & 0 & 0 \\ 0 & 0 & 0 & 0 & 1 & \dots & 0 & 0 \\ \dots & \dots & \dots & \dots & \dots & \dots & \dots & \dots \\ 0 & 0 & 0 & 0 & 0 & \dots & 1 & 0 \end{pmatrix}$$

It is not then possible for the coefficient vector f to be determined from f·A·A'=p·A' directly by multiplying both sides of the equation on the right by $(A \cdot A')^{-1}$. The reason for this is that, because A is constructed independently of the residual signal and of the impulse response of the synthesis filter, the inverse does not exist, since the determinant of A is always zero: if A is symmetric, then det(A)=det($A^t$). Furthermore, det(A·B)=det(A)·det(B) and det(A·B)≠0 and det(B)≠0. R, $M^tM$ and H are square matrices having the same dimension. If the speech activity is sufficient, the residual signal matrix R may be assumed to be invertible. The impulse response matrix H is likewise invertible, because it is a triangular matrix whose main diagonal always has non-zero elements. However, $M^tM$ is never invertible; it contains null columns and null rows. If, for example, the second, fourth, sixth, . . . pulse in the RPE is zero, then the second, fourth, sixth, . . . rows and columns in $M^tM$ contain only zeros. Continued application of det(A·B)=det(A)·det (B) gives det(A·A')=0 ∀ R, H.

An FIR filter F(z) of length N, which would have to be used to filter the residual signal before it is sampled, in order to obtain the smallest possible synthesis error, is not uniquely determined by specifying the positioning of the non-zero pulses, by the synthesis filter, the target signal and the residual signal. If, after filtering of the residual signal, m pulses are intentionally set to zero, m linearly independent equations will be missing for the determination of the N filter coefficients. The rank of A is only as large as the number of non-zero pulses.

For the calculation of the "ideal RPE" (see above) the error measure used here is likewise employed. The error minimization must lead to the same resulting synthesis error in both methods, since the error criterion which is selected ensures that, apart from the boundary extrema, there is only one minimum. The excitation signals of the two exactly identical synthesis filters must thus exactly coincide in both cases: the vector z from this section and the vector b from the previous section are consequently identical. Setting $$b = f \cdot R \cdot M^t$$

in $$f \cdot R \cdot M^t \cdot M \cdot H \cdot H^t \cdot M^t \cdot M \cdot R^t = p \cdot H^t \cdot M^t \cdot M \cdot R^t$$

and multiplying on the right by $R \cdot M^t$ gives $$b \cdot (M \cdot H \cdot H^T \cdot M^T) = p \cdot H^T \cdot M^T,$$

if the invertibility of $M \cdot R' \cdot R \cdot M'$ is assumed, hence the equations for calculating the "ideal RPE". The system of equations in f can be formally transformed into the system in b. Reciprocally, the system in b can be transformed into the system in f, if $fRM^t$ is used instead of b and the equation is multiplied on the right by $MR^t$.

An example which will be considered is the case of N/2 non-zero pulses, the first non-zero pulse being located at the first position in the RPE vector.

$$b = z = f \cdot R \cdot M^t$$

$$= \begin{pmatrix} r(0) & r(1) & r(2) & r(3) & \dots & r(N-1) \\ r(-1) & r(0) & r(1) & r(2) & \dots & r(N-2) \\ r(-2) & r(-1) & r(0) & r(1) & \dots & r(N-3) \\ r(-3) & r(-2) & r(-1) & r(0) & \dots & r(N-4) \\ \dots & \dots & \dots & \dots & \dots & \dots \\ r(-(N-1)) & r(.(N-2)) & r(-(N-3)) & r(-(N-4)) & \dots & r(0) \end{pmatrix} \cdot$$

$$\begin{pmatrix} 1 & 0 & 0 & 0 & 0 & \dots & 0 \\ 0 & 0 & 0 & 0 & 0 & \dots & 0 \\ 0 & 1 & 0 & 0 & 0 & \dots & 0 \\ 0 & 0 & 0 & 0 & 0 & \dots & 0 \\ 0 & 0 & 1 & 0 & 0 & \dots & 0 \\ \dots & \dots & \dots & \dots & \dots & \dots & \dots \\ 0 & 0 & 0 & 0 & 0 & \dots & 1 \end{pmatrix}$$

$$= (f_0 \quad f_1 \quad f_2 \quad \dots \quad f_{N-1}) \cdot$$

$$\begin{pmatrix} r(0) & r(2) & r(4) & \dots \\ r(-1) & r(1) & r(3) & \dots \\ r(-2) & r(0) & r(2) & \dots \\ \dots & \dots & \dots & \dots \\ r(-(N-1)) & r(-(N-3)) & r(-(N-5)) & \dots \end{pmatrix}$$

Written as a system of equations in f, this gives $$\begin{pmatrix} r(0) & r(-1) & r(-2) & \dots & r(-(N-1)) \\ r(2) & r(1) & r(0) & \dots & r(-(N-3)) \\ r(4) & r(3) & r(2) & \dots & r(-(N-5) \\ \dots & \dots & \dots & \dots & \dots \\ r(N-2) & r(N-3) & r(N-4) & \dots & r(-1) \end{pmatrix} \cdot \begin{pmatrix} f_0 \\ f_1 \\ f_2 \\ \dots \\ f_{N-1} \end{pmatrix} = \begin{pmatrix} b_0 \\ b_1 \\ b_2 \\ \dots \\ b_{N/2-1} \end{pmatrix}.$$

Only N/2 equations are available for calculating the N filter coefficients. The system can be satisfied with arbitrarily many different coefficient vectors f. Since, however, in order to minimize the synthesis error, it is sufficient to satisfy the system of equations in an arbitrary way, it is expedient to choose a "comfortable" coefficient set for the (N−m) selectable coefficients, m=rank (A), multiply with the above matrix and take the coefficients which are formed to the right-hand side of the equation. The remaining system of reduced order is thereby uniquely solvable.

In an RPE-LTP coder, the filter F(z) is not re-calculated when the target signal and the impulse response of the synthesis filter have changed. The filter coefficients are constant. The amplitude frequency response of this filter has the profile of a speech spectrum regarded as "typical". The filter in question is a low-pass filter having a smooth transition from the pass band to the stop band. The limiting frequency is in the region of 1300 Hz. The filter F(z) may be regarded as a low-pass filter preceding the sampler. However, the smooth transition from the passband to the stop band gives rise to alias components. Overall, this procedure represents quite a rough approximation. This is because the amplitude frequency response of F(z) varies not inconsiderably.

In practice, the speech signal cannot be fully decorrelated by linear decorrelation filtering. The spectrum is therefore not white, but merely flatter than the original spectrum and generally of lower intensity. The assumption that the entire band can be ascertained merely by knowing the baseband, is a rough approximation and, in particular in the case of talkers who have high voices, causes a not inconsiderable error which becomes clearly evident in an RPE-LTP coder because only the bottom third of the entire band is transmitted, which corresponds to subsampling by a factor of 3.

Accordingly, 45 bit/5 ms, corresponding to 9 kb/s, are needed for transmitting the stochastic excitation. A less accurate quantization of the individual pulses leads to a clearly inferior speech quality, and the latter can be improved by reducing the sub-sampling factor, but this increases the transmission rate. This method is therefore ruled out for improving the RPE-LTP coder. Aside for the quality losses due to the way in which the RPE is determined, further restrictions which, for their part, were then necessary in an RPE-LTP coder for reasons of outlay, reduce the quality. Thus, a synthesis filter of only eighth order is employed. The long-term prediction is carried out using a single-stage predictor. The associated gain is scalar-quantized coarsely.

Attempts to improve the RPE-LTP coder did not therefore seem sensible in the search for an algorithm to provide a significantly improved speech coder for the digital mobile telephony network. This widespread assumption has had the effect that the very RPE excitation type has de facto no longer been considered for modern time-domain coders, and the time-domain speech coders developed after the RPE-LTP coder essentially work using the CELP principle and have determined their stochastic excitation by elaborate searching in trained or algebraically constructed codebooks.

CELP Principle

FIG. 1 shows the CELP principle as it is typically used. A target signal to be approximated is rebuilt by searching (at least) two codebooks. In this case, a distinction is drawn between an adaptive codebook (a2), the task of which is to rebuild the harmonic speech components, and one or more stochastic codebooks (a4) which are used to synthesize those speech components which cannot be obtained by prediction. The adaptive codebook (a2) is changed on the basis of the speech signal, while the stochastic codebook (a4) is time-invariant. The search for the best code vectors takes place in such a way that, instead of a common, that is to say simultaneous, search taking place in the codebooks, as would be needed for optimal selection of the code vectors, for reasons of outlay the adaptive codebook (a2) is searched first. When the code vector which is the best according to the error criterion has been found, its contribution to the reconstructed target signal is subtracted from the target vector (target signal) to give the part of the target signal which is still to be reconstructed by a vector from the stochastic codebook (a4). The search in the individual codebooks is carried out with the same principle. In both cases, the ratio of the square of the correlation of the filtered code vector with the target vector to the energy of the filtered target vector is calculated for all code vectors. The code vector which maximizes this ratio is taken to be the best code vector, which minimizes the error criterion (a5). The preceding error weighting (a6) weights the error according to the characteristics of the human ear. Its position is transmitted to the decoder. The correct gain (gain 1, gain 2) is determined implicitly for each code vector by calculating the said ratio. After the best candidate has been found from the two codebooks, common optimization of the gain can be used to reduce the quality-impairing effect of the sequentially performed codebook search. In this case, the original target vector is re-specified and the gains most suitable for the now selected code vectors are calculated, these gains usually differing slightly from the ones determined during the codebook search.

The CELP principle is characterized in that, in order to find the best code vector, each candidate vector needs to be filtered individually (a3) and compared with the target signal. In spite of the sequential searching of the two codebooks, this process entails considerable outlay which was too much to be dealt with in real time even on powerful floating-point signal processors in the case of the 1024 vector codebook size proposed in the first CELP publication. The main emphasis of the work with CELP coders has therefore (and continues to) concerned how to utilize the advantages of the CELP principle without having to accept the disadvantage of high computing outlay.

The object of the invention is therefore to provide a speech synthesis method with which, in the specified bit rate range, the searching of stochastic codebooks can be completely omitted without impairing the speech quality and without increasing the transmission rate in comparison with the case when stochastic codebooks are used.

The solution to this object is specified in claim 1. Advantageous developments of the invention can be found in the subclaims.

According to the invention, a method is provided for synthesizing a frame of a speech signal in a speech codec, for example of the CELP type, in which a synthesis filter of the speech coder is supplied with an excitation vector consisting of an adaptive excitation part a and a stochastic excitation part c, the stochastic excitation part c being formed by the following parameters, which are taken from a previously calculated ideal RPE sequence:

a) The position of the first non-zero pulse in the ideal RPE sequence, b) the positions of a preselected number of strongest pulses in the ideal RPE sequence, c) the amplitudes of these strongest pulses, and d) the signs of these strongest pulses, these parameters furthermore being transmitted to the speech decoder in order to produce the stochastic excitation part c there as well.

Almost all time-domain coders currently have a similar structure. The synthesis filter coefficients of a tenth order filter are often converted into reflection factors or into line spectrum frequencies (LSFs) and (vector) quantized. The excitation of the synthesis filter is composed of the weighted superposition of the adaptive excitation and the stochastic excitation. Both excitation parts are sequentially determined by a more or less suboptimally performed codebook search, the adaptive excitation, i.e. the excitation part which can be obtained by repeating old excitation values, being determined first. The degree to which the codebook search is suboptimal is a determining factor for the computing outlay and speech quality. The aim is to analyze as few code vectors as possible within the analysis-by-synthesis loop in order to limit the computing outlay. This requires a simple but appropriate preselection of the code vectors to be analyzed within the loop. On the one hand, the vector quantization of the excitation makes it possible to reduce the transmission rate and, on the other hand, for equal transmission rate it leads to a lower quantization error than scalar quantization.

The novel method according to the invention which is described here for determining the stochastic excitation is very different from this approach. No preselection criterion is used, nor is the stochastic excitation vector-quantized. Scalar quantization in the conventional sense, in which the aim is to quantize the transmitted pulses as accurately as possible, is not involved either. The essential quality problem in an RPE-LTP coder is that the RPE is a version of the decorrelated speech signal subsampled by a factor of three. Even exact quantization of the RPE pulses does not significantly improve the quality. Although reducing the subsampling factor to two does notably improve the quality, this requires a considerably higher transmission rate. The fact that the transmission rate of the coder is not to be increased rules this method out.

The long-term prediction used in the RPE-LTP coder is quite rough, so that the RPE also has to contribute further harmonic speech components. Conversely, in modern analysis-by-synthesis coders, the long-term prediction is performed with considerably greater accuracy than in the RPE-LTP coder, so that the remaining stochastic excitation actually has an essentially noisy character and a correct phase angle for the stochastic excitation is substantially more important than accurate amplitude quantization. This fact is also the reason why ACELPs (Algebraic Code Excited Linear Prediction) with codewords allowing only one or two amplitude levels give good results. In an ACELP, a codebook search answers the question of which pulse positions are to receive pulses. Answering this question generally entails considerable outlay, even if the codewords consist only of zeros and ones and the signs have already been determined beforehand by suboptimal methods.

This outlay is superfluous, at least, for example, in the 13 kb/s bit rate range. The positions where the non-zero pulses are to lie can be deduced without audible loss of quality from an "ideal RPE" calculated with considerably less outlay.

In order to reduce the computing outlay when solving the system of equations in order to determine the "ideal" RPE, the stochastic excitation may, according to the invention, be re-determined, for example every 2.5 ms. This corresponds to a sub-frame length of N=20 samples. In this case, a tenth order system of equations needs to be solved. The resulting amplitudes of the "ideal RPE" are then taken into consideration in order to find the "surviving pulses". At least half of the RPE amplitudes are relatively small. Only a few of the amplitudes are large. It is sufficient to let the large amplitudes survive, for example make them equal, and then transmit only their position and sign to the decoder. Three to five of the strongest pulses are sufficient for good/very good speech quality. The excitation obtained in this way has the form of a pseudo-MPE (Multi Pulse Excitation).

The invention will be explained in more detail below with reference to the drawing, in which:

FIG. 2A and FIG. 2B show how, in an illustrative embodiment of the invention, a stochastic excitation according to FIG. 2*b* is produced from an ideal RPE according to FIG. 2*a*. To do this, the following parameters or values are taken from the ideal RPE:

the position of the first non-zero pulse in the ideal RPE;

the positions of the surviving pulses, that is to say those pulses whose amplitude is greater than a predetermined threshold; and the signs of these surviving pulses.

In this case, the amplitudes of the surviving pulses are preferably all equal or normalized, for example up to one, so that specifying the sign is also equivalent to specifying the amplitude which is to be communicated to the coder.

Determining the excitation does not necessarily require exact determination of the amplitudes by solving a system of coupled equations. The corresponding pulse positions and signs can also be derived from a sub-optimally solved system. Any methods in which the amplitudes, positions and signs of the large pulses are substantially conserved may be considered. One of these methods is to determine the pulses sequentially, by initially determining the first pulse, subtracting its contribution to the reconstructed target signal from the target signal p, then calculating the second pulse, etc.

The described method for obtaining a pseudo-MPE from an "ideal" RPE is a combined closed-loop/open-loop method. The "ideal" RPE is optimal with regard to the target signal to be approximated (closed loop), while the "ideal" RPE is quantized without regard to this target signal, but on the basis of the positions of the maximum pulses in the RPE vector (open loop). The computing outlay for the quantization thus becomes negligibly small. The very costly searching of stochastic codebooks, which is otherwise customary for speech coders in this bit rate range, is omitted.

The application of this method will be demonstrated below with reference to an example of a speech coder, but is not restricted thereto.

Figure 1:
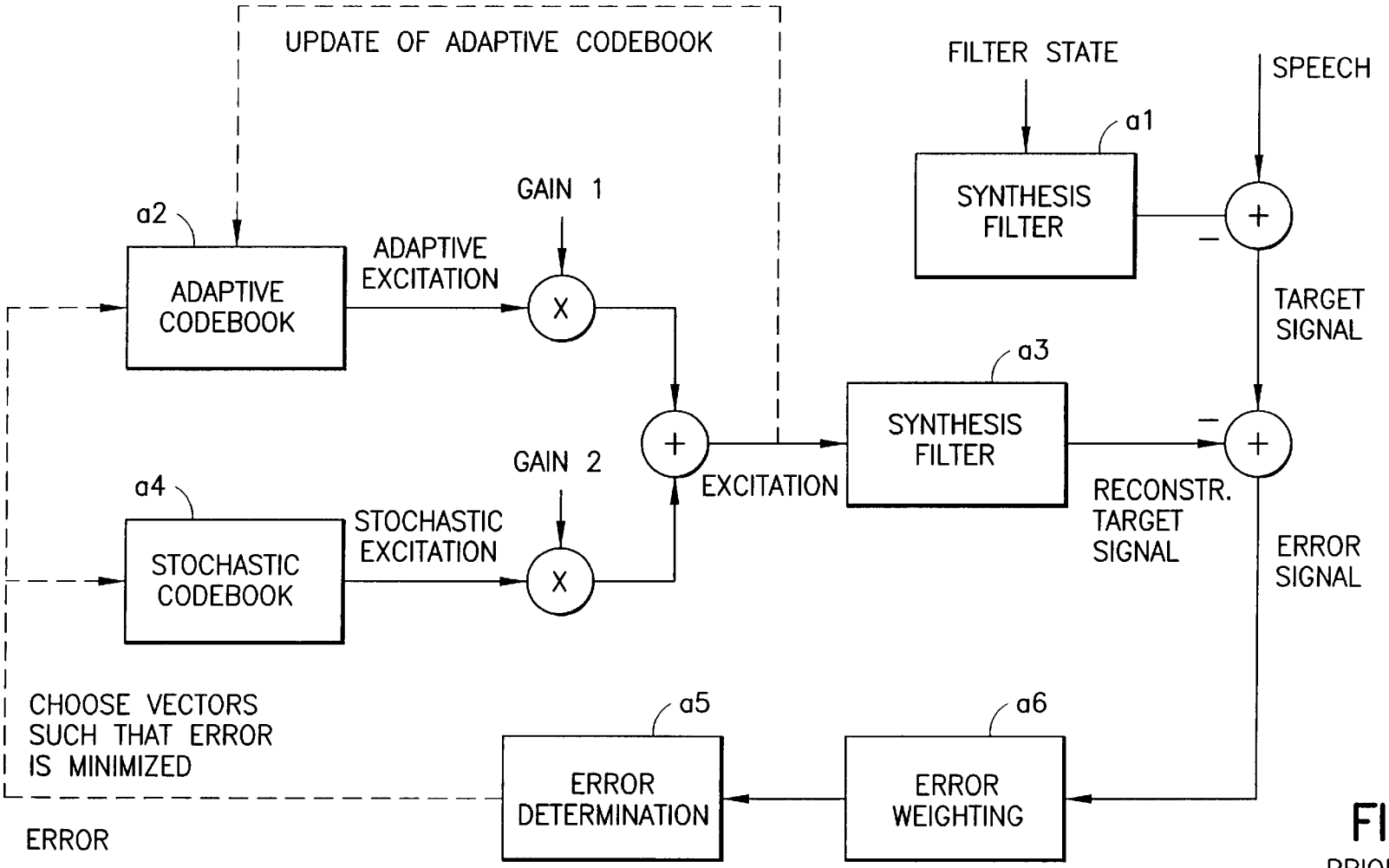
FIG. 1 PRIOR ART
FIG. 1 represents the CELP principle, as it is customarily used.
Figure 2A:
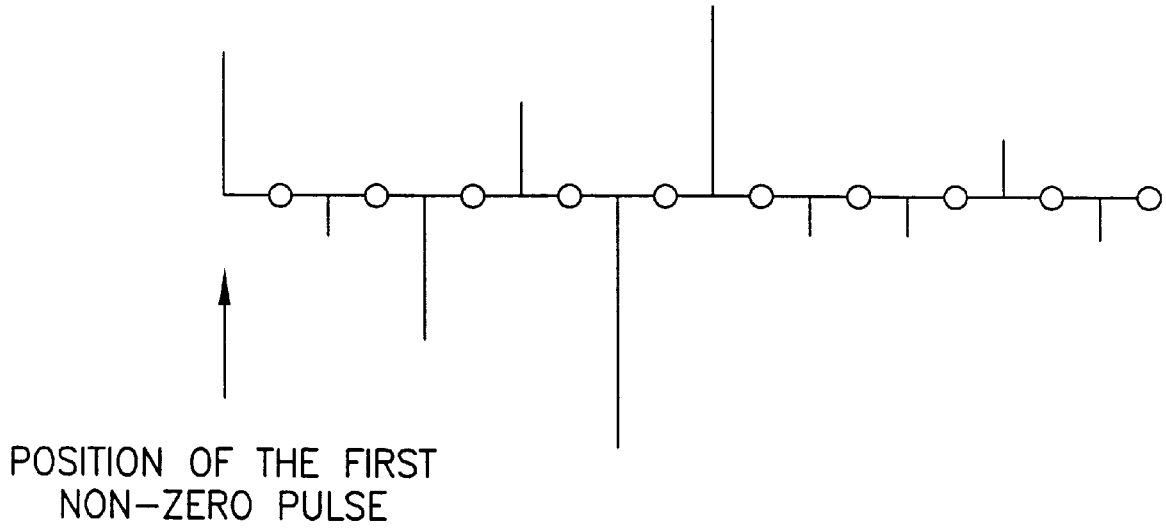
FIG. 2A and FIG. 2B represent the generation according to the invention of a stochastic excitation (FIG. 2*b*) as a function of an ideal RPE sequence (FIG. 2*a*)
Figure 2B:
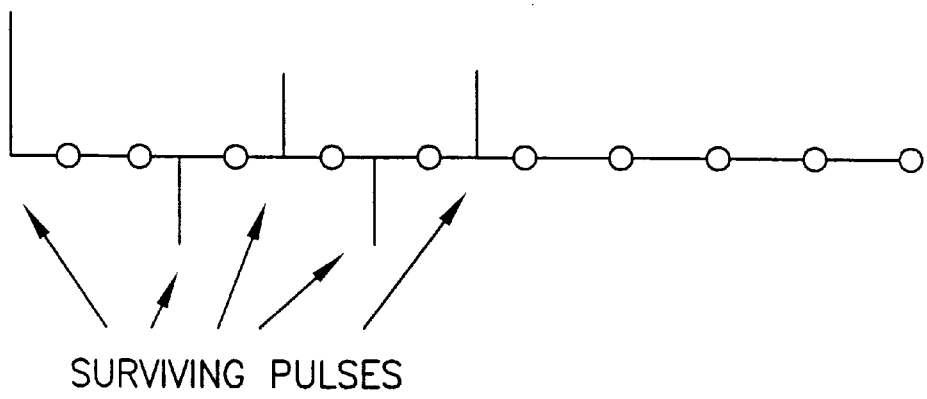
Figures 3, 3A:
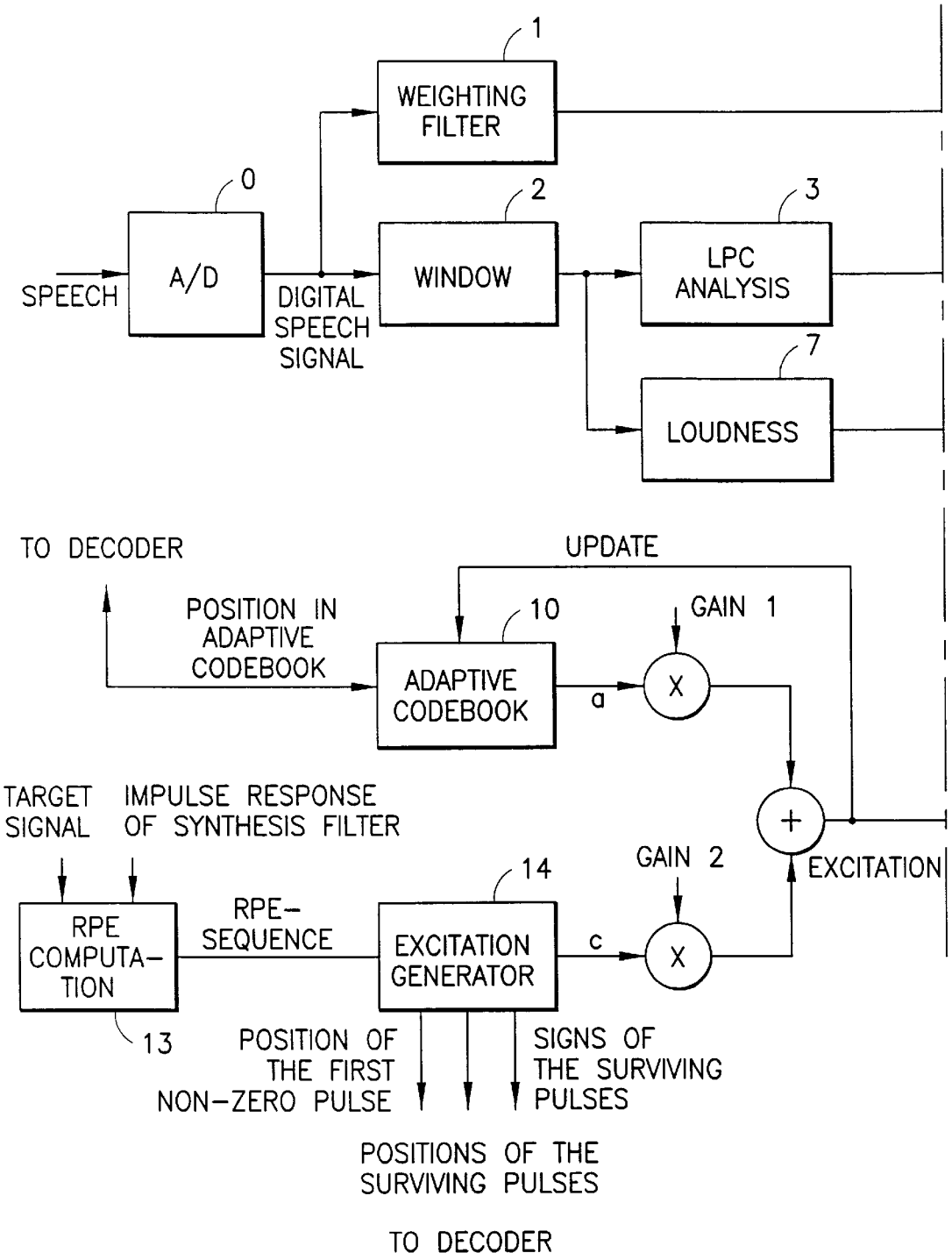
FIG. 3 shows a speech coder used in the method according to the invention.
Figure 3B:
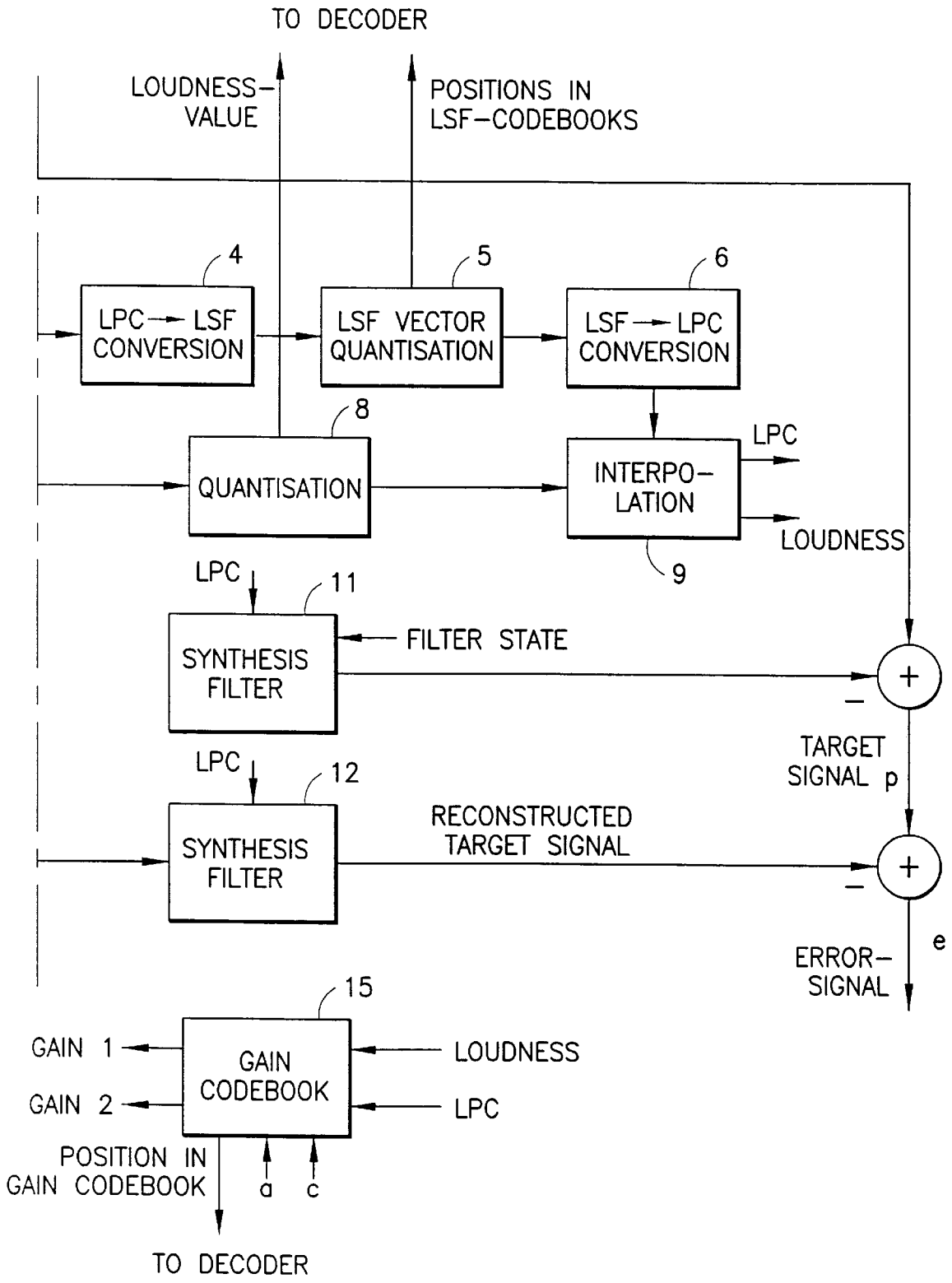

FIG. 3 shows the speech coder. After the analogue speech signal has been sampled in block 0, the digital speech signal is subjected to windowing 2, before the LPC analysis 3 for determining the coefficients of the synthesis filter 11, 12 is carried out. The purpose of this windowing is to reduce the cut-off effects due to the finite length of the LPC analysis interval. The synthesis filter is divided into two blocks, block 11 representing the ringing part of the filter resulting from the values in the filter memory, and block 12 representing the synthesis filter with memory set to zero at the start of each filtering operation. The superposition of the two output signals constitutes the output signal of the synthesis filter. Before their quantization 5, conversion 4 of the direct coefficients into line spectrum frequencies (LSFs), which have more favourable properties in terms of quantization than direct filter coefficients, takes place. The LSFs are then quantized 5 and the positions in the corresponding LSF codebooks are transmitted to the decoder. The windowed digital speech signal is characterized by a loudness value 7 which is proportional to the energy contained in the signal. This value is logarithmically quantized 8 and also transmitted to the decoder. The quantized values of the LSFs and the loudness are used in the coder as well as in the decoder. Before they are used, the quantized LSFs are converted 6 back into direct filter coefficients and, like the loudness, linearly interpolated 9 with the corresponding values of the last analysis interval. The aforementioned calculations take place once per analysis frame, which here has a length of 20 ms corresponding to 160 samples.

The following calculations take place eight times per analysis frame, that is to say every 2.5 ms. The first step is to calculate the current target signal which is to be rebuilt. To do this, first of all the ringing component of the synthesis filter 11 due to previous excitations is subtracted from the weighting-filtered digital speech signal from block 1. The weighting filtering places emphasis on ranges in the speech signal which are important for the ear. The adaptive excitation a is then determined. It is taken from the adaptive codebook 10 which contains a specific number of past excitation values of the synthesis filter. This codebook 10 updates its content after each sub-frame. The excitation vector a selected from the adaptive codebook is the one whose version, filtered and scaled with a gain (gain 1), which is closest to the target vector p in terms of an arbitrarily chosen error criterion, here a least squares criterion. After the filtered and scaled adaptive excitation a has been determined, it is subtracted from the target vector p. This leaves the residual error which is to be minimized by the stochastic excitation vector c. This excitation vector c is not then taken from a codebook, as is normal practice in the case of such coders, but is calculated directly from the target signal p and the impulse response h of the synthesis filter: as explained above, the "ideal" RPE is determined in block 13 from the said signals. The excitation generator 14 determines the positions of, for example, the five strongest pulses and their signs, and sets the other RPE pulses to zero. The surviving pulses are given the same amplitude and then differ only by their sign. After both partial excitation vectors (adaptive excitation vector a and stochastic excitation vector c) are known, the gains are together optimized and vector-quantized 15.

Figure 4A:
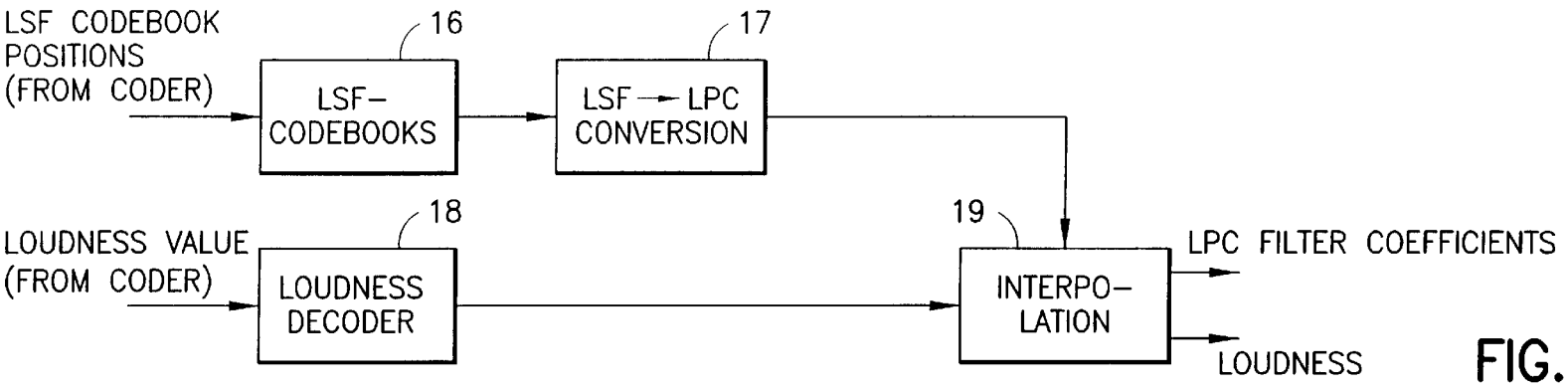
FIG. 4A and FIG. 4B show a speech decoder used in the method according to the invention.
Figure 4B:
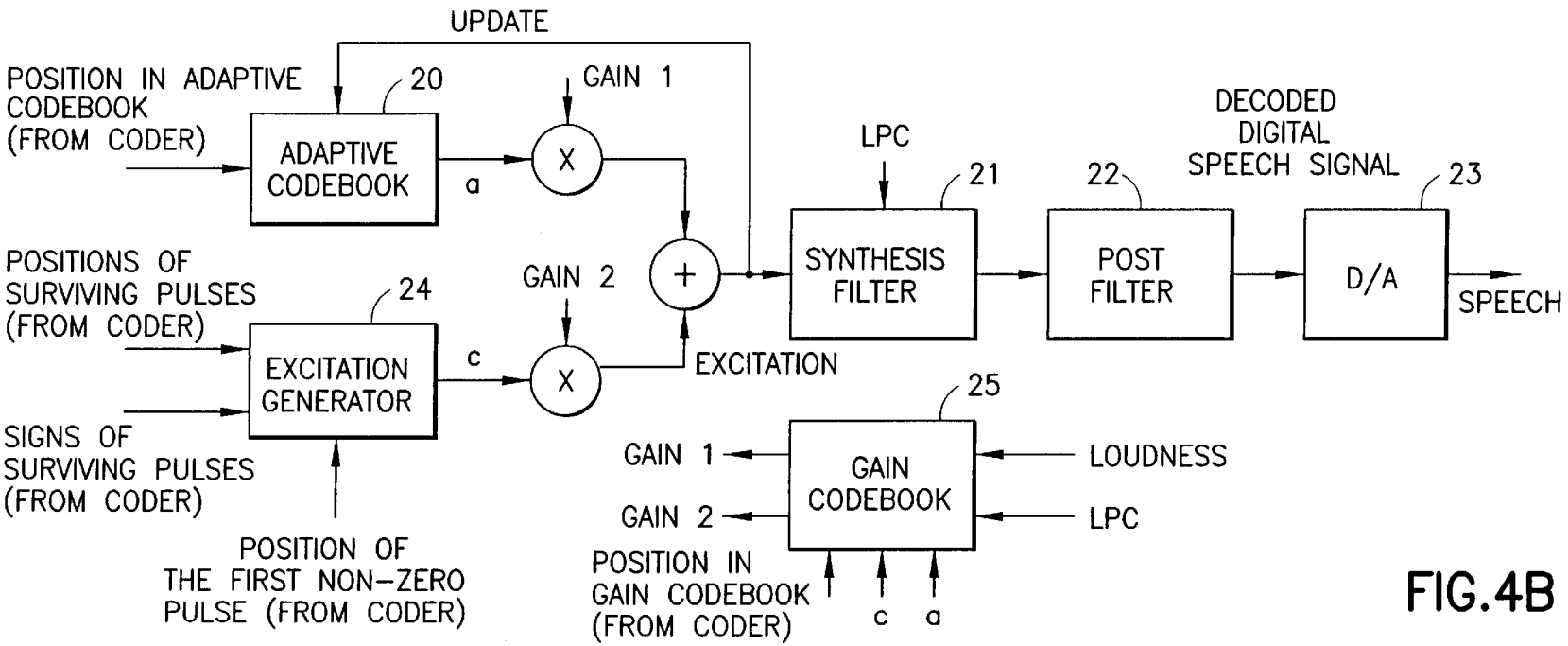

In the speech decoder according to FIGS 4A and 4B, the stochastic codebook which would otherwise exist is replaced by an excitation generator 24 which receives the abovementioned parameters from the speech coder, that is to say the position of the first non-zero pulse of the ideal RPE sequence, the positions of the surviving pulses and the signs of the surviving pulses. From these parameters, the stochastic excitation vector c is formed and, after amplification, fed to the synthesis filter 21.

The other processing steps to be carried out by the decoder correspond essentially to the ones which have already been carried out in the coder, apart from the fact that the code vectors needed for constructing the filter coefficients and the excitation are taken directly from the various codebooks because of the position indications sent by the coder. Furthermore, the synthetic speech signal which is produced at the output of the LPC synthesis filter 21 is also post-processed. The post-processing filter 22 emphasises the regions in the speech signal which are important for audible perception, and helps at least partly to suppress noise which has been produced by the coding itself and by possible transmission errors. After final D/A conversion 23, an analogue speech signal is once more provided.

What is claimed is:

1. Method for synthesizing a frame of a speech signal in a speech codec, in which a synthesis filter of a speech coder of the speech codec is supplied with an excitation vector consisting of an adaptive excitation part and a stochastic excitation part, which is taken from a previously calculated ideal Regular Pulse Excitation (RPE) sequence, comprising steps of:

a) determining a position of a first non-zero pulse in the ideal RPE sequence, b) determining positions of a preselected number of strongest pulses in the ideal RPE sequence, c) determining amplitudes of the preselected number of strongest pulses, and d) determining signs of the preselected number of strongest pulses, wherein the positions, amplitudes, and signs furthermore being transmitted to a speech decoder of the speech codec in order to produce the stochastic excitation part there as well.

2. Method according to claim 1, characterized in that the amplitudes of the strongest pulses which are taken are given the same arbitrarily selectable value.

3. Method according to claim 1, characterized in that the preselected number of strongest pulses is in the region of N/6 . . . N/4, N being the number of samples in a sub-frame of an analysis frame.

4. Method according to claim 3, characterized in that the stochastic excitation part is recalculated for each sub-frame.

* * * * *